US011745208B2

(12) United States Patent
Mullin

(10) Patent No.: US 11,745,208 B2
(45) Date of Patent: Sep. 5, 2023

(54) SPRINKLER EXTENSION DEVICE

(71) Applicant: Scott Mullin, Grand Junction, CO (US)

(72) Inventor: Scott Mullin, Grand Junction, CO (US)

( * ) Notice: Subject to any disclaimer, the term of this patent is extended or adjusted under 35 U.S.C. 154(b) by 349 days.

(21) Appl. No.: 17/248,280

(22) Filed: Jan. 18, 2021

(65) Prior Publication Data

US 2021/0252545 A1 Aug. 19, 2021

Related U.S. Application Data

(60) Provisional application No. 62/976,481, filed on Feb. 14, 2020.

(51) Int. Cl.
*B05B 15/65* (2018.01)
*B05B 1/02* (2006.01)

(52) U.S. Cl.
CPC ..... *B05B 15/65* (2018.02); *B05B 1/02* (2013.01)

(58) Field of Classification Search
CPC ..... B05B 15/65; B05B 15/68; B05B 15/656; B05B 15/74; B05B 1/02
USPC ..... 239/203–206, 600
See application file for complete search history.

(56) References Cited

U.S. PATENT DOCUMENTS 4,234,125 A 11/1980 Lieding
4,479,611 A 10/1984 Galvis
4,796,809 A 1/1989 Hunter
5,938,121 A 8/1999 Ferguson et al.
6,193,168 B1 * 2/2001 Bedford ..... B05B 15/65 239/600
6,629,648 B1 * 10/2003 Jones ..... B05B 15/74 239/206
7,500,620 B2 3/2009 Cordua
10,814,343 B2 10/2020 Ketterling
10,933,434 B1 * 3/2021 Pfanstiehl ..... B05B 15/628
2005/0194464 A1 9/2005 Bruninga
2013/0168466 A1 7/2013 White
2020/0070198 A1 3/2020 Ketterling
2020/0164397 A1 * 5/2020 Shoemake ..... B05B 15/72
2021/0053084 A1 2/2021 Ketterling
2021/0323020 A1 10/2021 Penrod

OTHER PUBLICATIONS

"What's your K IT?: Kap-It Riser" brochure, 2 pages (copy of front and back).

* cited by examiner

*Primary Examiner* — Steven J Ganey
(74) *Attorney, Agent, or Firm* — Trenner Law Firm, LLC; Mark D. Trenner

(57) ABSTRACT

A sprinkler extension device is disclosed to adjust a height of an existing pop-up sprinkler installed in the ground. An example sprinkler extension device includes an extension riser configured to mate on a first end to a sprinkler riser. The extension riser is further configured to mate on a second end to a spray cap of the existing pop-up sprinkler installed in the ground. The example sprinkler extension device also includes an extension coupling configured to mate on a first end to a sprinkler housing. The extension coupling is further configured to mate on a second end to a sprinkler head of the existing pop-up sprinkler installed in the ground.

18 Claims, 17 Drawing Sheets

SPRINKLER EXTENSION DEVICE

PRIORITY CLAIM

This application claims the priority filing benefit of U.S. Provisional Patent Application No. 62/976,481 filed Feb. 14, 2020 titled "Sprinkler Extension Device" of Scott Mullin, hereby incorporated by reference as though fully set forth herein.

BACKGROUND

A typical irrigation pop-up sprinkler head is flush with the dirt level or ground surface. Over time, however, the sprinkler unit may sink down below the surface and into the ground. Sometimes the sprinkler unit can sink so low (e.g., about 2 inches below the surface), that when the riser pops up, the sprinkler spray cap does not reach a sufficient height to adequately spray water out to any distance for good watering coverage. Water spraying from the sprinkler spray cap sitting so low in the ground can even be blocked by the grass itself.

In general, homeowners just leave their pop-up sprinklers alone even after sinking. A repair is often considered to be too time consuming, and requires physical labor to dig up the old sprinkler and extend the threaded nipple to raise the sprinkler head to ground level so that it can function properly again. Homeowners simply don't want to have to pay a sprinkler repair professional to do the job correctly. Nor do most homeowners want to tear up the grass themselves and/or they don't even know how to extend the threaded nipple to raise the sprinkler up to ground level.

DETAILED DESCRIPTION

Figure 1:
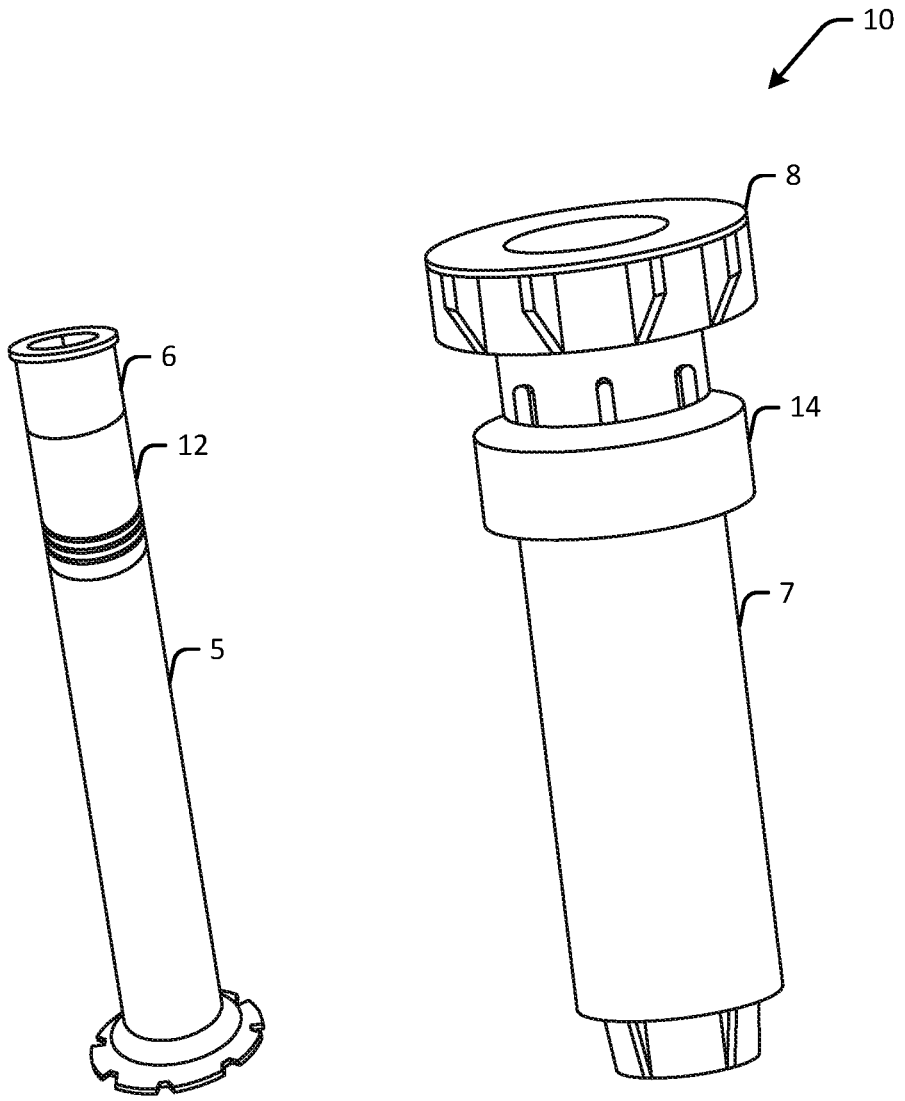
FIG. 1 shows an example sprinkler extension device already attached to an irrigation pop-up sprinkler.

A sprinkler extension device is disclosed. An example of the sprinkler extension device solves the problem of a pop-up sprinkler that has sunk below the surface level of the ground so far that it needs to be raised, e.g., because it does not water the grass adequately in the sprinkler area. The sprinkler extension device enables repair by ordinary homeowners without much physical labor (e.g., there is no digging up of the sprinkler) or the expense of having to hire a professional. The example sprinkler extension device extends the top portion of the existing irrigation pop-up sprinkler so that it can rise sufficiently high enough to spray water without interference from the ground and/or grass.

An example sprinkler extension device can be implemented to adjust a height of an existing pop-up sprinkler while installed in the ground. The example sprinkler extension device includes an extension riser configured to mate on a first end to a sprinkler riser. The extension riser is further configured to mate on a second end to a spray cap of the existing pop-up sprinkler installed in the ground. The example sprinkler extension device also includes an extension coupling configured to mate on a first end to a sprinkler housing. The extension coupling is further configured to mate on a second end to a sprinkler head of the existing pop-up sprinkler installed in the ground.

To raise the sprinkler to its proper height, various size extensions risers and couplings may be provided. For example, if a sprinkler head needs to be raised by 2 inches, a 2 inch sprinkler extension device may be implemented, including a 2 inch extension riser and a 2 inch extension coupling. Other extension heights may also be implemented, as will be readily understood by those having ordinary skill in the art after becoming familiar with the teachings herein. The extension riser is coupled to the existing pop-up sprinkler riser, and the extension coupling is coupled to the sprinkler housing of the existing pop-up sprinkler (e.g., even when installed in the ground).

The example sprinkler extension device may be provided in various sizes and may be configured to fit already existing pop-up body sprinklers and/or those developed in the future. For example, though shown having threads in the drawings, other fittings may also be provided such as but not limited to fitted, snap-together, click-in, interlocking, etc. The example sprinkler extension device may be manufactured for different types and/or brands of pop-up sprinklers (e.g., different sizes, fittings, etc.).

The example sprinkler extension device makes it easy and cost-effective for a typical homeowner to raise a sprinkler without tearing up the grass, and without the physical labor or expense of a typical sprinkler repair.

In an example, multiple extensions can be implemented (e.g., stacked) to achieve even higher extensions with the device described herein.

Before continuing, it is noted that as used herein, the terms "includes" and "including" mean, but is not limited to, "includes" or "including" and "includes at least" or "including at least." The term "based on" means "based on" and "based at least in part on."

Figure 2:
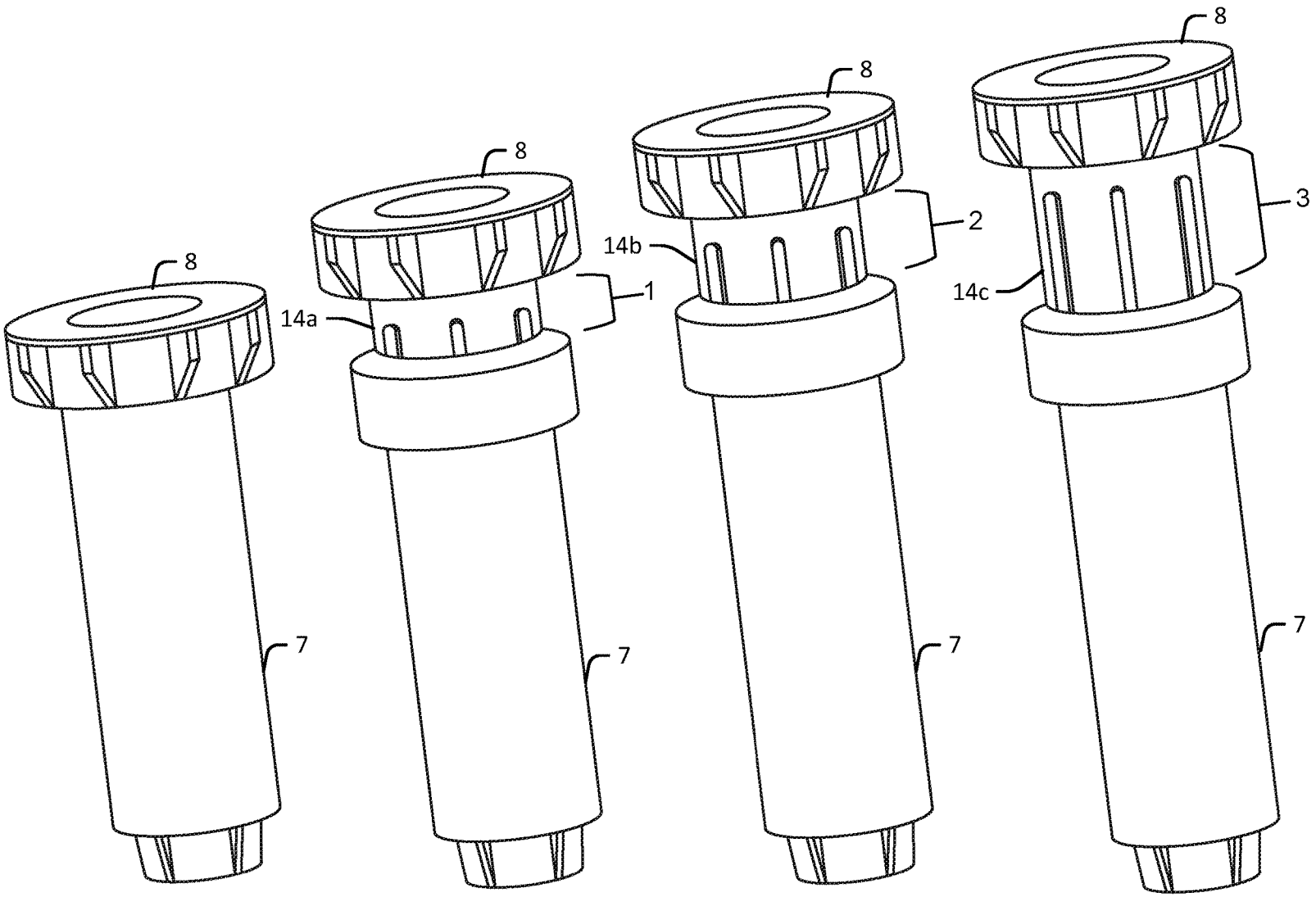
FIG. 2 illustrates different extension heights configurable with the example sprinkler extension device.
Figure 3:
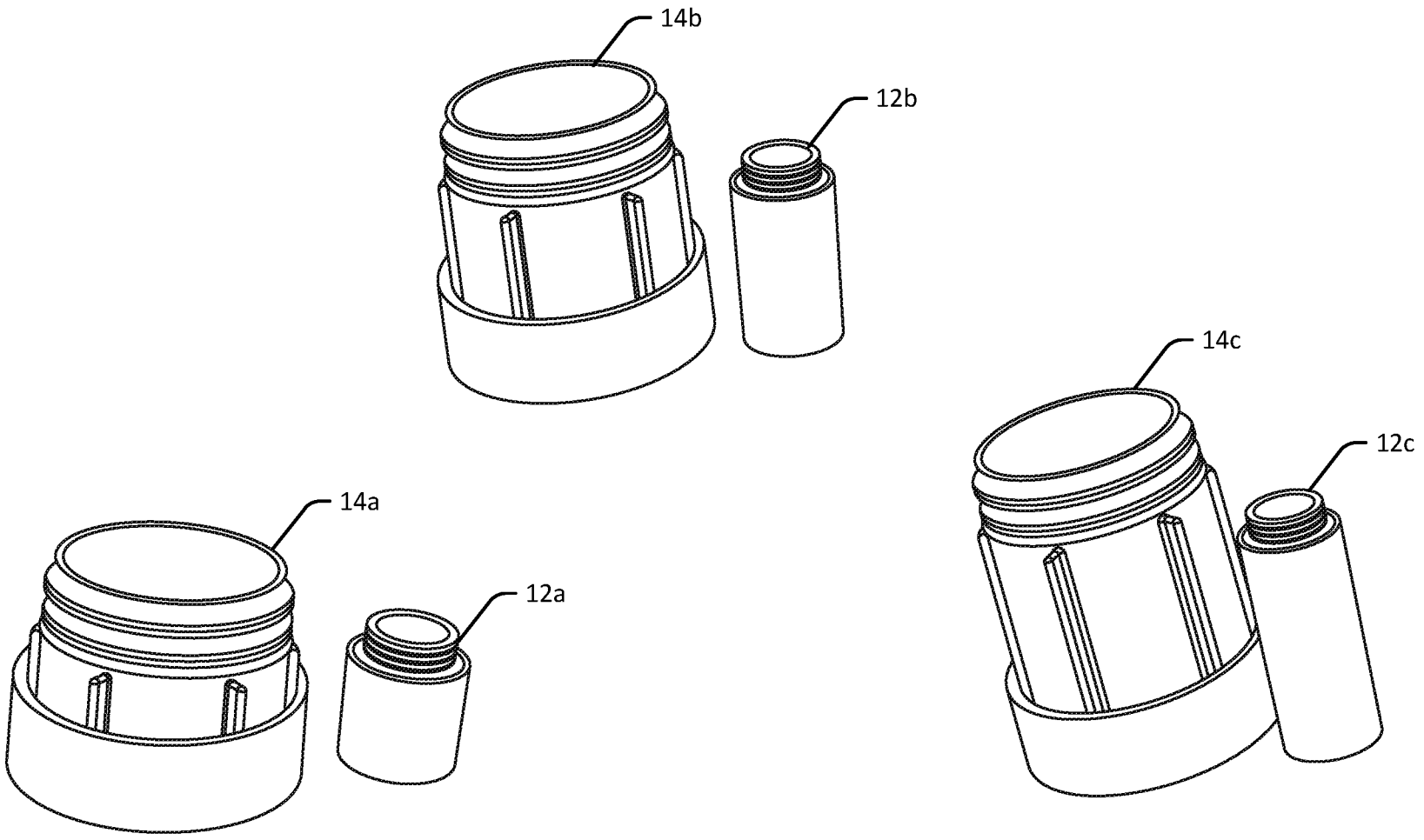
FIG. 3 shows examples of different extension riser and coupling components of the example sprinkler extension device.

FIG. 1 shows an example sprinkler extension device 10. The example sprinkler extension device 10 can be used for various extension heights (e.g., from 1 to 3 inches) for use with existing pop-up sprinklers. FIG. 2 illustrates different extension heights (height 1, height 2, and height 3) configurable with the example sprinkler extension device 10. FIG. 3 shows examples of different extension risers 12*a-c* and extension couplings 14*a-c* of the example sprinkler extension device 10, corresponding to heights 1-3 in FIG. 2).

An example of the sprinkler extension device includes an extension riser 12 configured to mate on a first end to a sprinkler riser 5. The extension riser 12 is also configured to mate on a second end to a spray cap 6. The sprinkler extension device also includes an extension coupling 14 configured to mate on a first end to a sprinkler housing 7. The extension coupling 14 is also configured to mate on a second end to a sprinkler head 8.

In an example, the sprinkler riser 5 and the spray cap 6 are part of an existing pop-up sprinkler installed in the ground. In addition, the sprinkler housing 7 and the sprinkler head 8 are part of an existing pop-up sprinkler installed in the ground. The extension riser 12 and extension coupling 14 may be provided in various sizes to accommodate different adjustment heights for an existing pop-up sprinkler installed in the ground.

In an example, the extension riser 12 is provided in a length corresponding to a length of the extension coupling 14, both selected to accommodate different adjustment heights for an existing pop-up sprinkler installed in the ground.

In an example, the extension riser 12 and extension coupling 14 are configured to accommodate different types (e.g., brands) and specifications of sprinkler risers, spray caps, sprinkler housings, and sprinkler heads of existing pop-up sprinklers.

It is noted that while the sprinkler extension device 10 can be installed on an existing pop-up sprinkler installed in the ground, the existing pop-up sprinkler does not need to be installed in the ground. The sprinkler extension device 10 can also be installed on pop-up sprinklers that are not installed in the ground.

Figure 4:
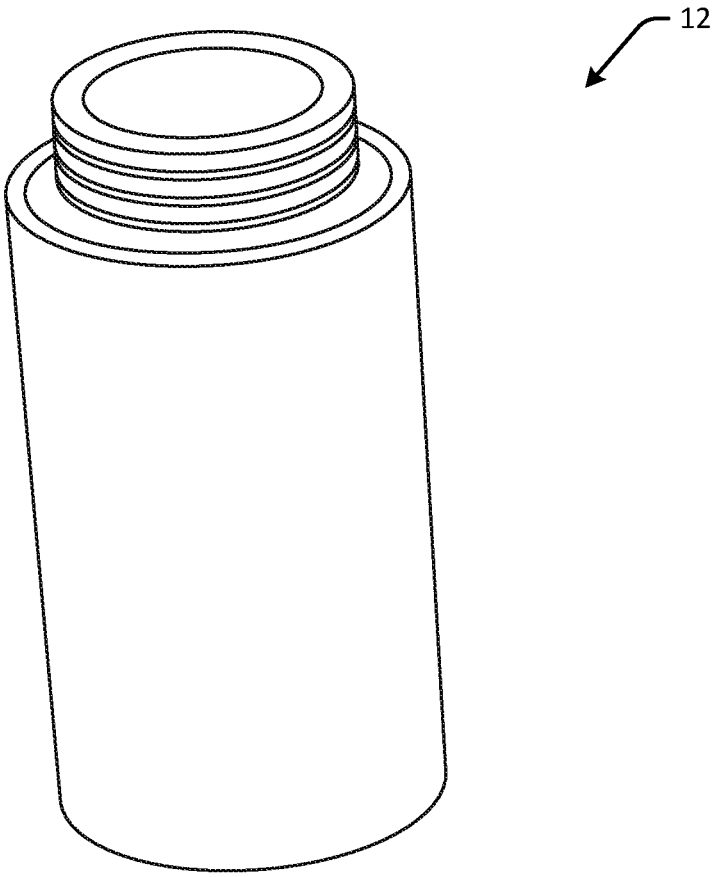
FIG. 4 is a close-up perspective view of an example riser component of the example sprinkler extension device.
Figure 5:
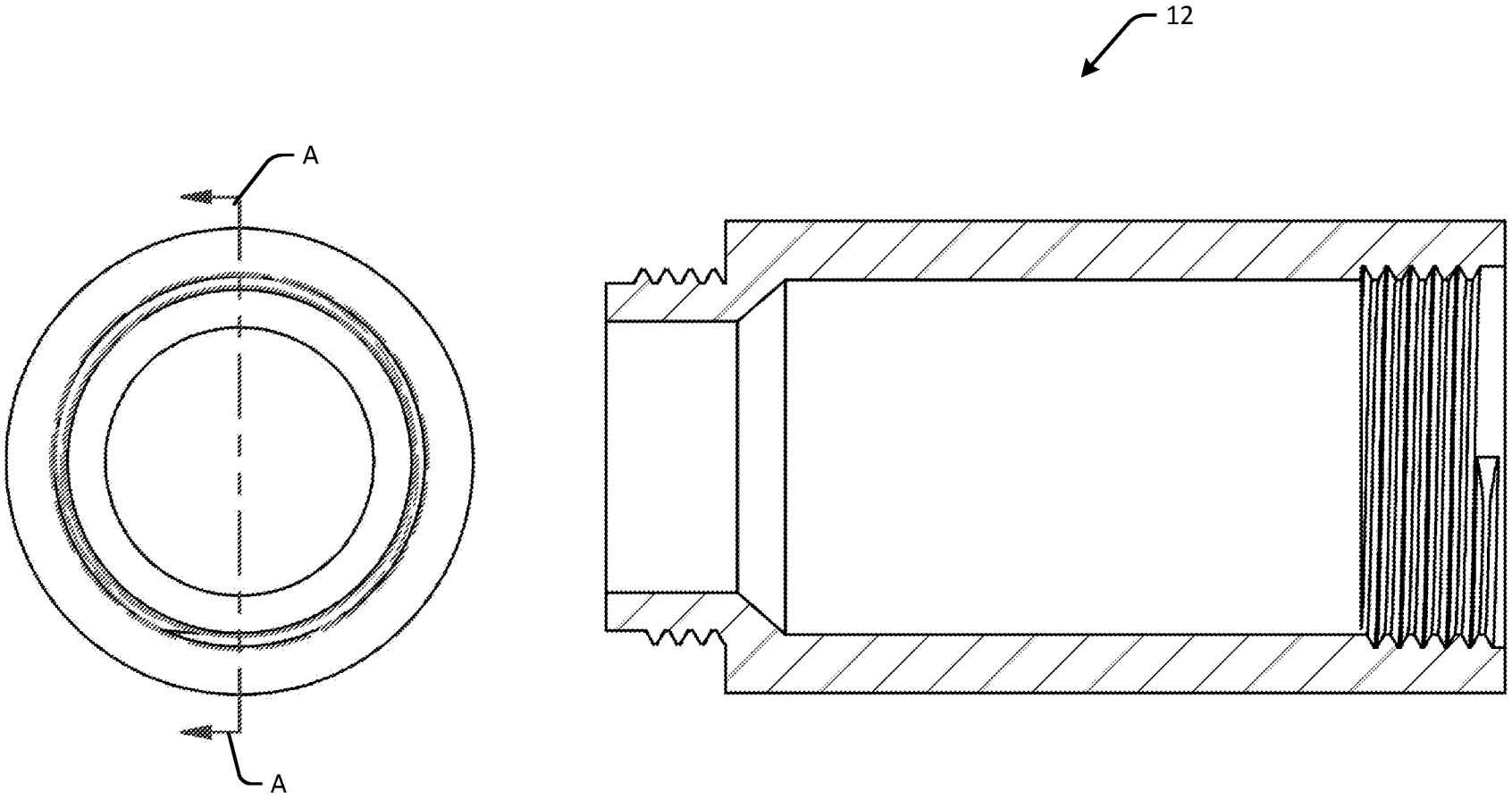
FIG. 5 is a cross-sectional view of the example riser component of the example sprinkler extension device shown in FIG. 4.

FIG. 4 is a close-up perspective view of an example extension riser 12 of the example sprinkler extension device 10. In an example, the extension riser 12 has an outer diameter that is substantially equal to an outer diameter of the sprinkler riser 5. FIG. 5 is a cross-sectional view of the example riser component of the example sprinkler extension device shown in FIG. 4. The side view shown on the right side of FIG. 5 is taken along lines A-A of the end view shown on the left side of FIG. 5.

In the example shown, the extension riser 12 includes female threads to engage with male threads on the sprinkler riser 5. The extension riser 12 also includes male threads to engage with female threads of the spray cap 6. It is noted that the device 10 is not limited to any particular type of threading. Indeed, other fitments may also be provided, including but not limited to slip fittings (with or without glue).

Figure 6:
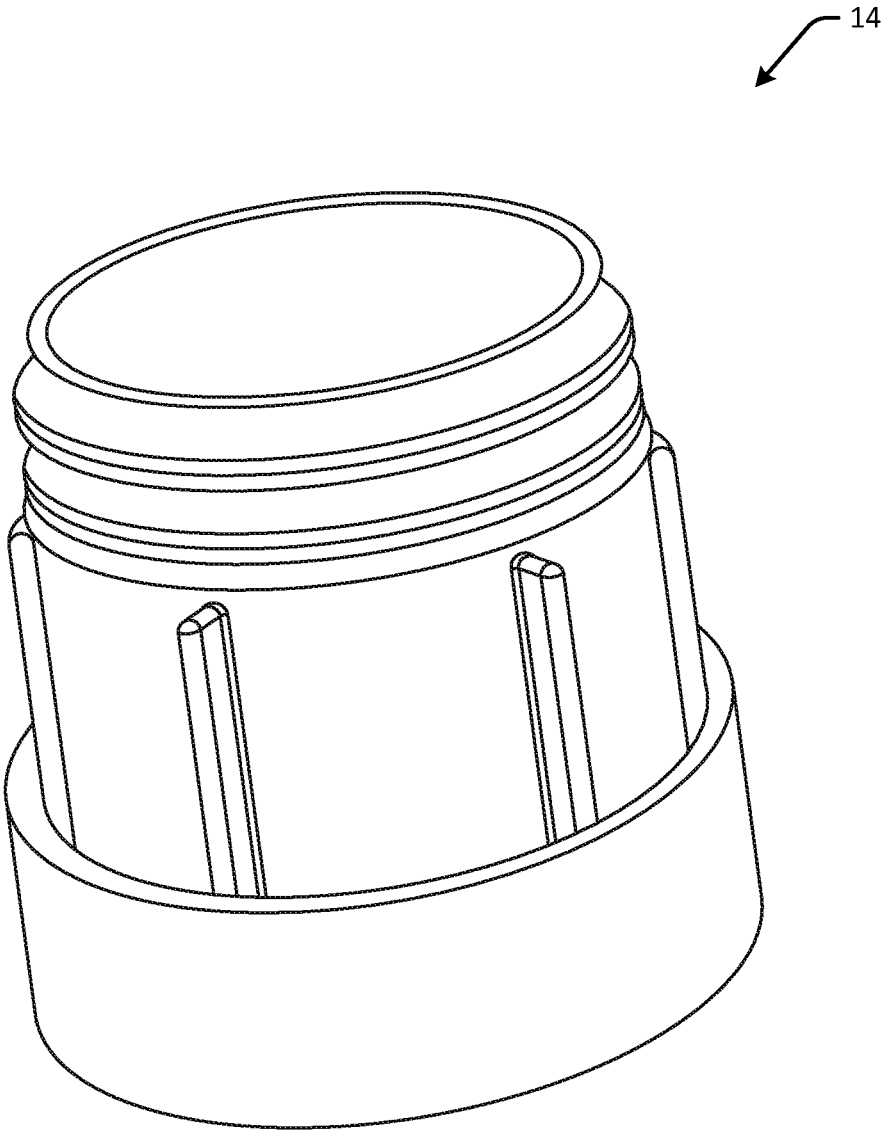
FIG. 6 is a close-up perspective view of a top end of an example coupling component of the example sprinkler extension device.

FIG. 6 is a close-up perspective view of a top end of an example extension coupling 14 of the example sprinkler extension device 10. In an example, the extension coupling 14 has an upper section and a lower section. The lower section has an outer diameter substantially equal to an inner diameter of the sprinkler housing 7. The upper section of the extension coupling 14 has an outer diameter that is smaller than the outer diameter of the lower section of the extension coupling 14.

In an example, the extension coupling 14 includes at least one ridge 16 on an outside wall of the extension coupling. A plurality of ridges 16 are shown spaced substantially equally around an outer perimeter of the extension coupling 14 in FIG. 6. The ridge(s) may be provided on or formed integral with the outside wall of the extension coupling 14 and provide a grip for the user's fingers to tighten/loosen the extension coupling 14 when connecting it to the sprinkler housing 7.

Figure 7:
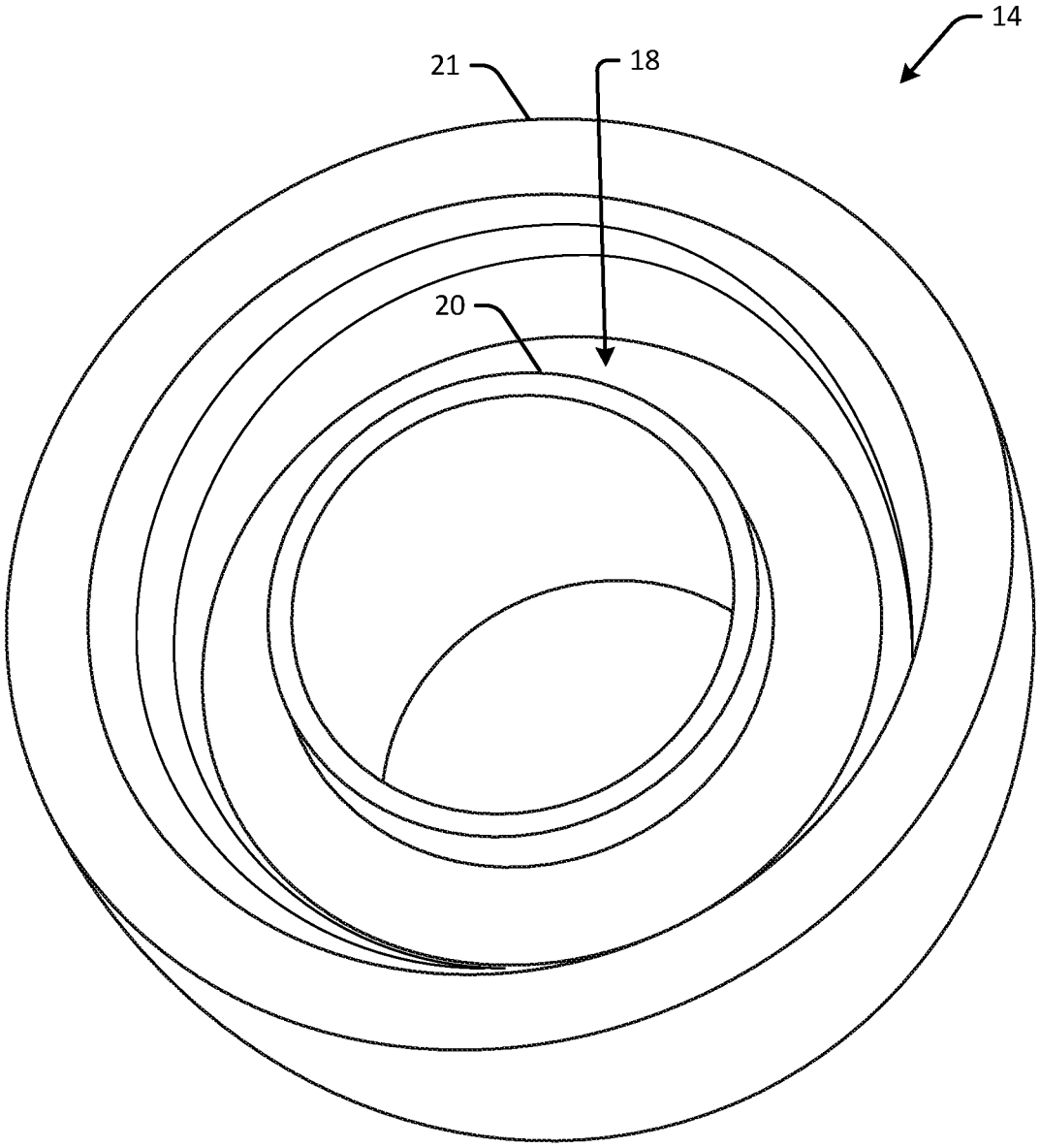
FIG. 7 is a close-up perspective view of a bottom end of an example coupling component of the example sprinkler extension device.

FIG. 7 is a close-up perspective view of a bottom end of the example coupling 14 component shown in FIG. 6 of the example sprinkler extension device 10. In the view shown in FIG. 7, an annular recess 18 is visible formed within the extension coupling 14. The annular recess 18 is configured to retain a first end of a spring 9 (see, e.g., FIG. 11). The annular recess 18 is formed between an inner wall 20 and an outer wall 21 in the extension coupling 14.

In an example, the annular recess 18 maintains the spring 9 within inner wall 20 which serves as a riser stop. The annular recess 18 also serves as a spring stop. Without the annular recess 18, the spring 9 would travel up the sprinkler body under pressure from water flow, and the riser 5 would not come back down when water pressure was relieved. To keep from having to replace the spring 9 with a longer spring for the extension, the position of the annular recess 18 in the extension coupling 14 is selected such that the spring 9 remains positioned close to the original stopping point of the spring 9 in the existing pop-up sprinkler.

Figure 8:
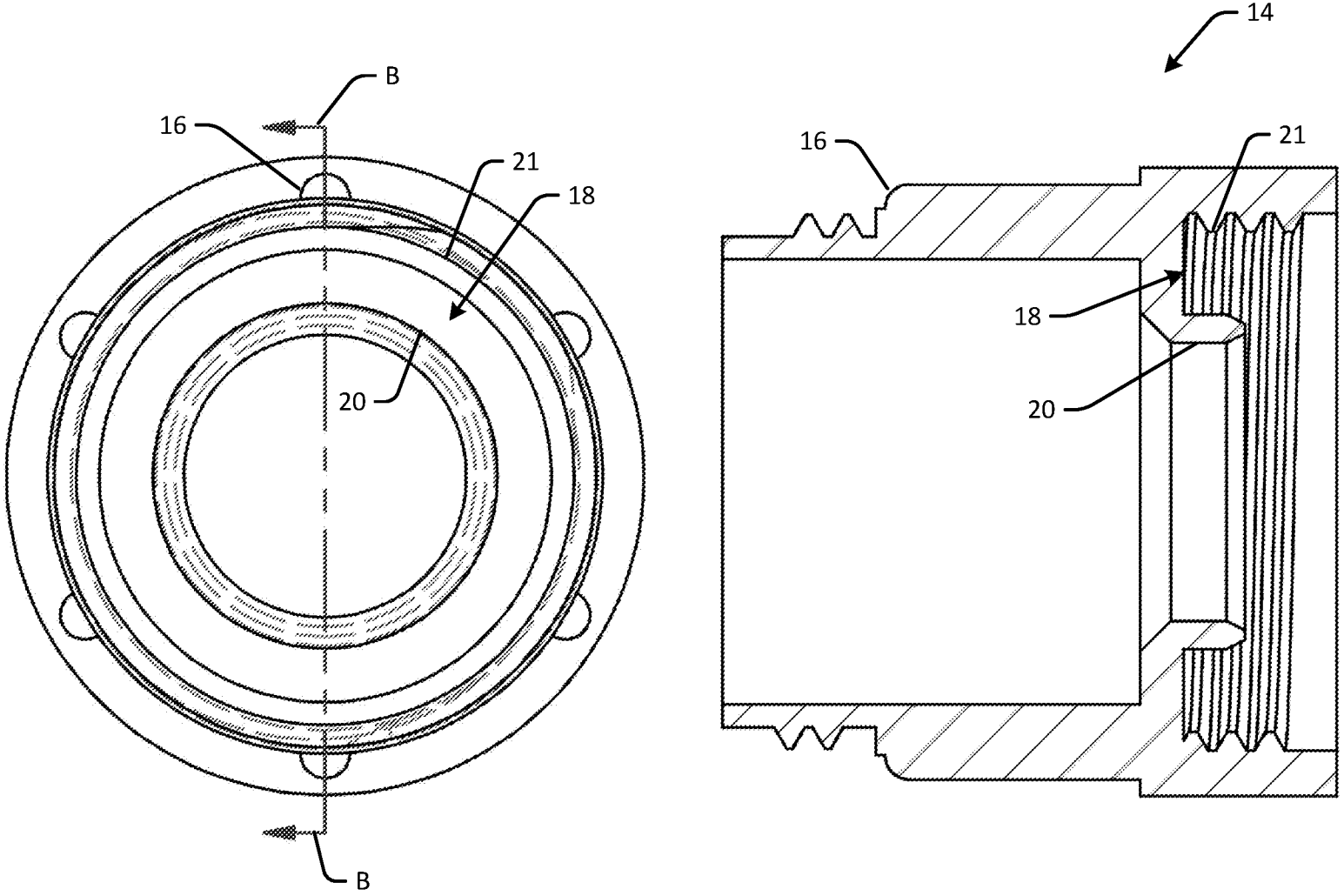
FIG. 8 is a cross-sectional view of the example coupling component of the example sprinkler extension device shown in FIGS. 6 and 7.

FIG. 8 is a cross-sectional view of the example coupling component of the example sprinkler extension device shown in FIGS. 6 and 7. The side view shown on the right side of FIG. 8 is taken along lines B-B of the end view shown on the left side of FIG. 8.

In the example shown, the extension coupler 14 includes female threads to engage with male threads on the sprinkler housing 7. The extension coupler 14 also includes male threads to engage with female threads of the sprinkler head 8. It is noted that the device 10 is not limited to any particular type of threading. Indeed, other fitments may also be provided, including but not limited to slip fittings (with or without glue).

It is noted that the examples described herein are provided for purposes of illustration, and are not intended to be limiting. Other devices and/or device configurations may be utilized to carry out the operations described herein.

Figure 9:
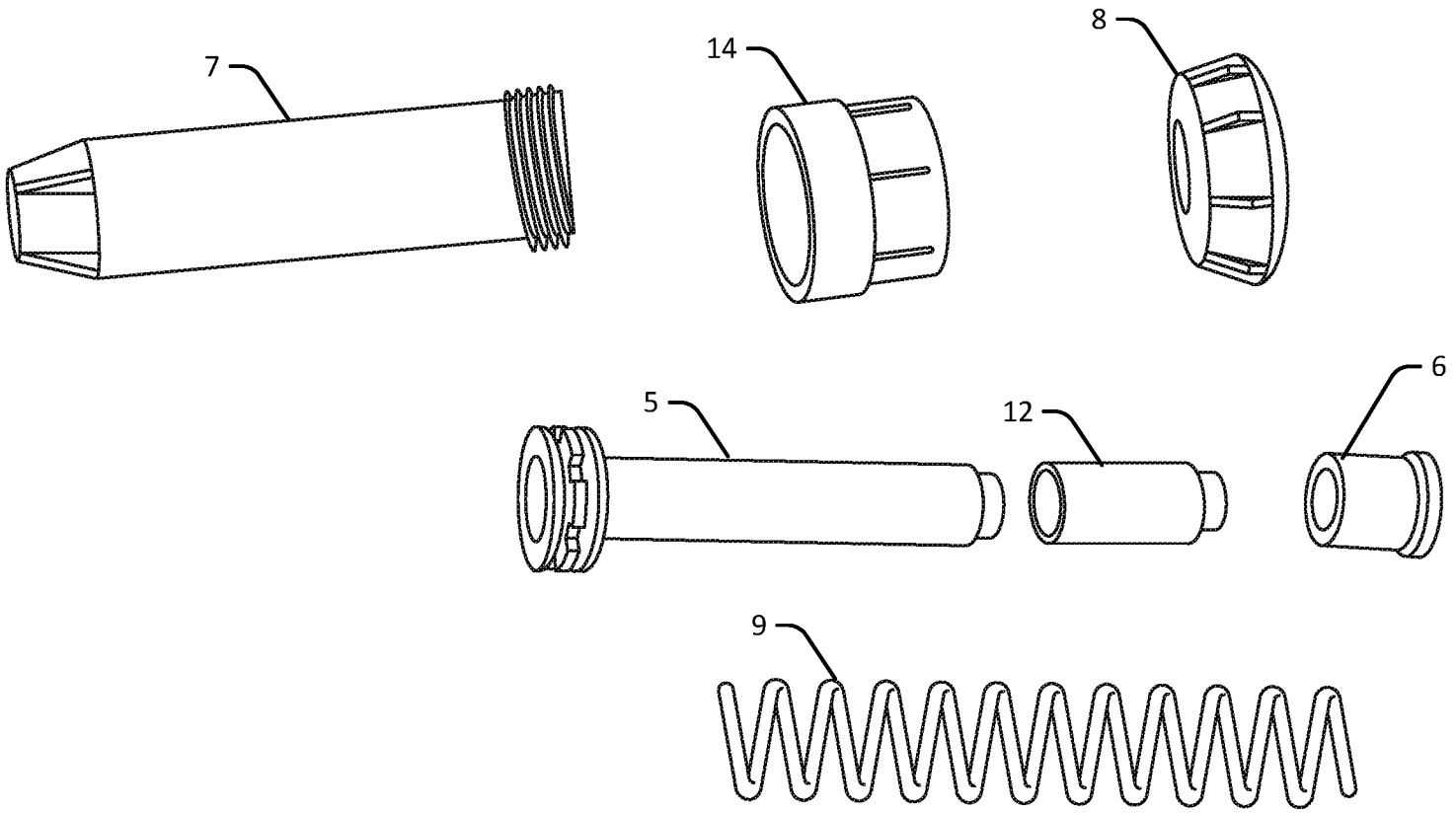
FIG. 9 shows example components of an existing pop-up body sprinkler, having been unassembled, along with an example extension riser and extension coupling of the sprinkler extension device.

FIG. 9 shows example components of an existing pop-up body sprinkler, having been unassembled, along with an example extension riser 12 and extension coupling 14 of the sprinkler extension device 10. The example sprinkler extension device 10 includes an extension riser 12 and an extension coupling 14, as shown in FIG. 9. The extension riser 12 is coupled with a riser 5 and spray cap 6 of an existing pop-up sprinkler. The extension coupling 14 is configured to mate with the sprinkler housing 7 and sprinkler head 8 of the existing pop-up sprinkler.

FIGS. 10-17 illustrate example assembly of an example sprinkler extension device 10 onto the existing pop-up body sprinkler. It is noted that the operations shown and described herein are provided to illustrate example implementations. It is noted that the operations are not limited to the ordering shown. Still other operations may also be implemented.

Figure 10:
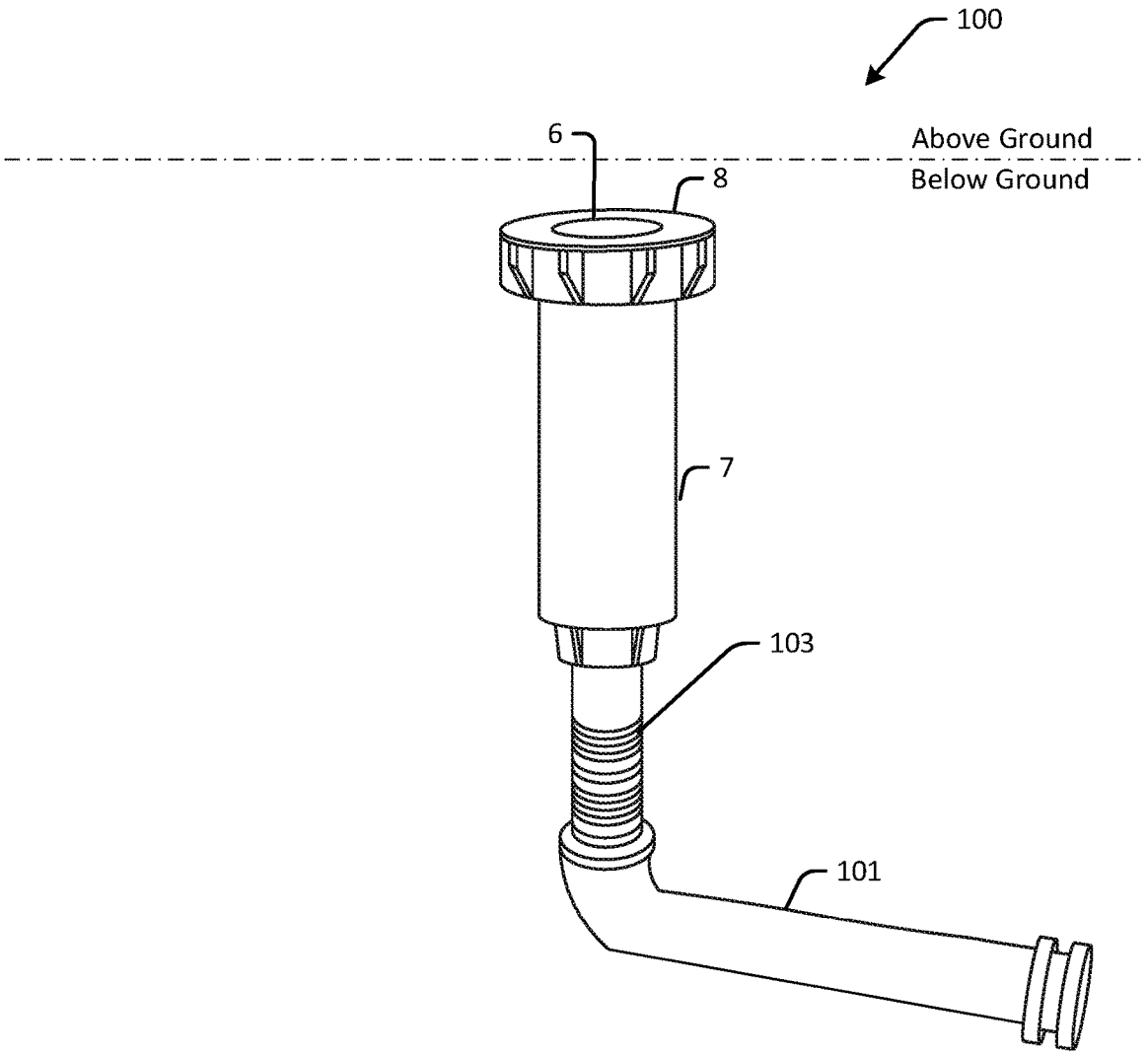
FIGS. 10-17 illustrate example assembly of an example sprinkler extension device onto an existing pop-up body sprinkler.

FIG. 10 shows an example of an existing pop-up body sprinkler 100 as it may be connected to a water supply line 101 via extension nipple 103. When the sprinkler head 8 of an existing pop-up body sprinkler (e.g., sprinkler 100) is below the surface level of the ground so that the spray cap does not rise sufficiently high to water the grass (or otherwise needs to be raised), a user may implement the sprinkler extension device 10 described herein to remedy this. In an example, the user may install the sprinkler extension device 10 without having to dig up the existing pop-up body sprinkler 100 and can perform the operations with the existing pop-up body sprinkler 100 still in the ground.

Figure 11:
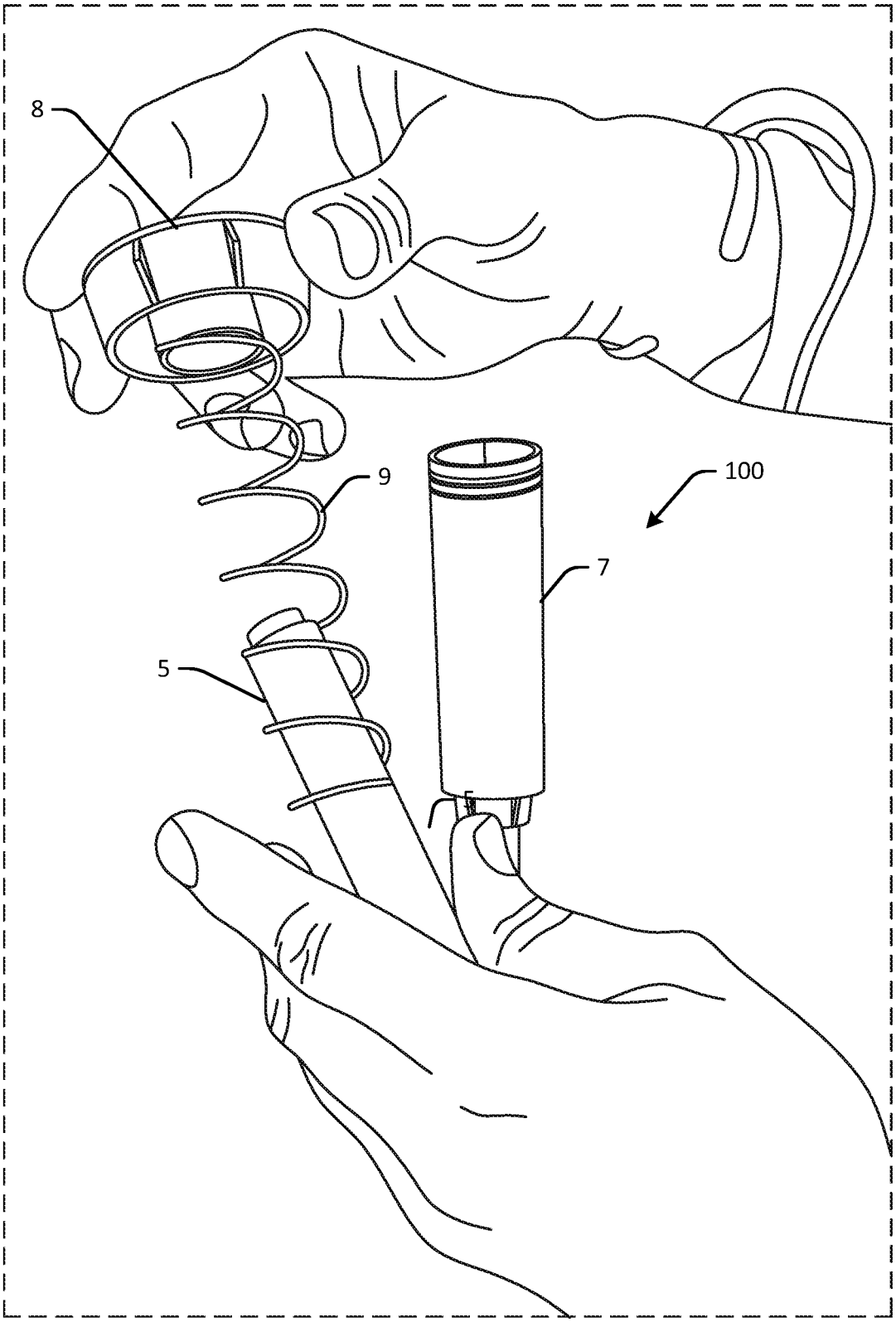

As shown in FIG. 11, the user may remove the sprinkler head 8 and spray cap 6 from the sprinkler housing 7 of the existing pop-up sprinkler 100, and pull out the spring 9 and riser 5 from the sprinkler housing 7.

Figure 12:
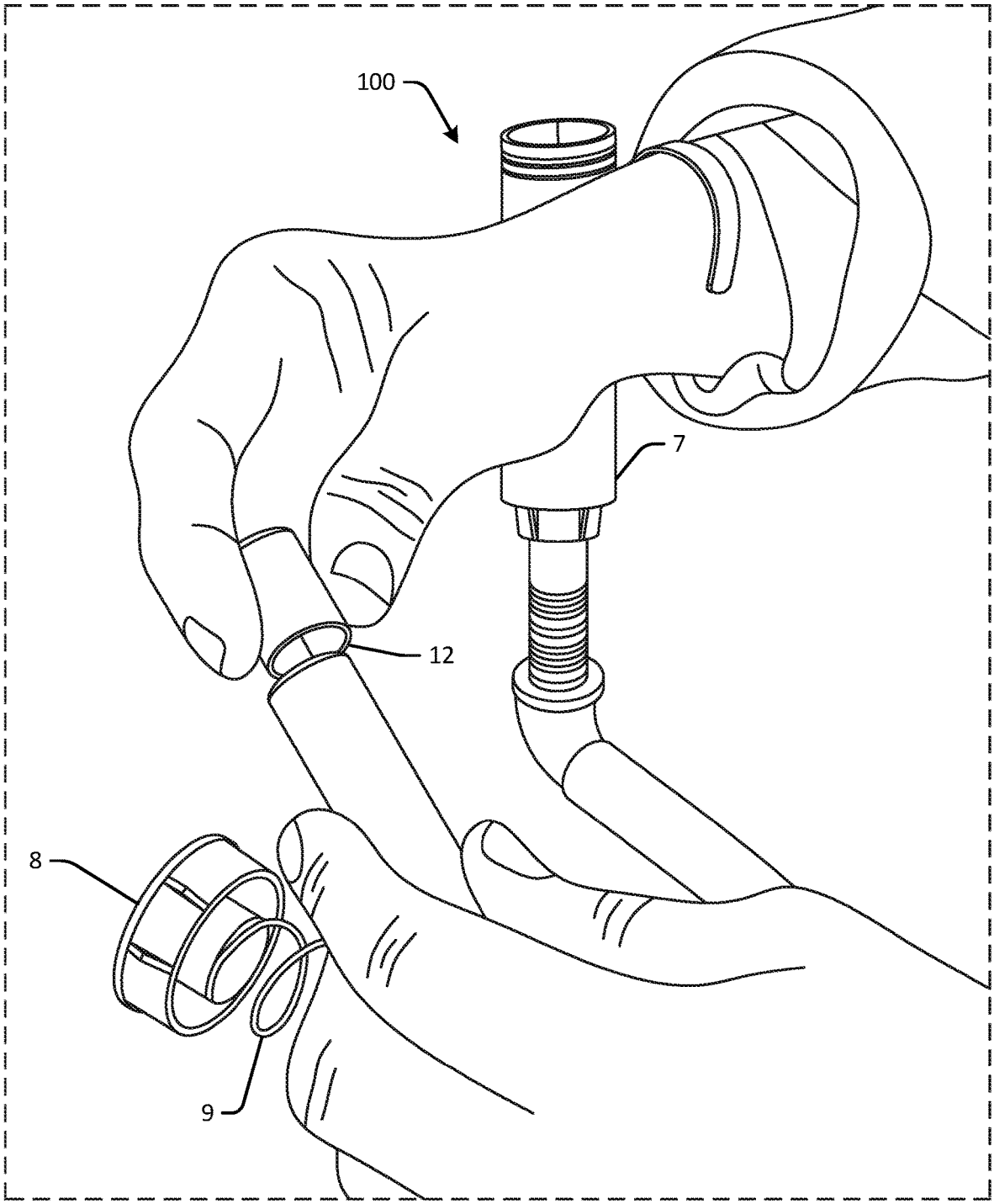

As shown in FIG. 12, the user may attach the extension riser 12 to the sprinkler riser 5 of the existing pop-up sprinkler 100, e.g., by threading the extension riser 12 onto the sprinkler riser 5.

Figure 13:
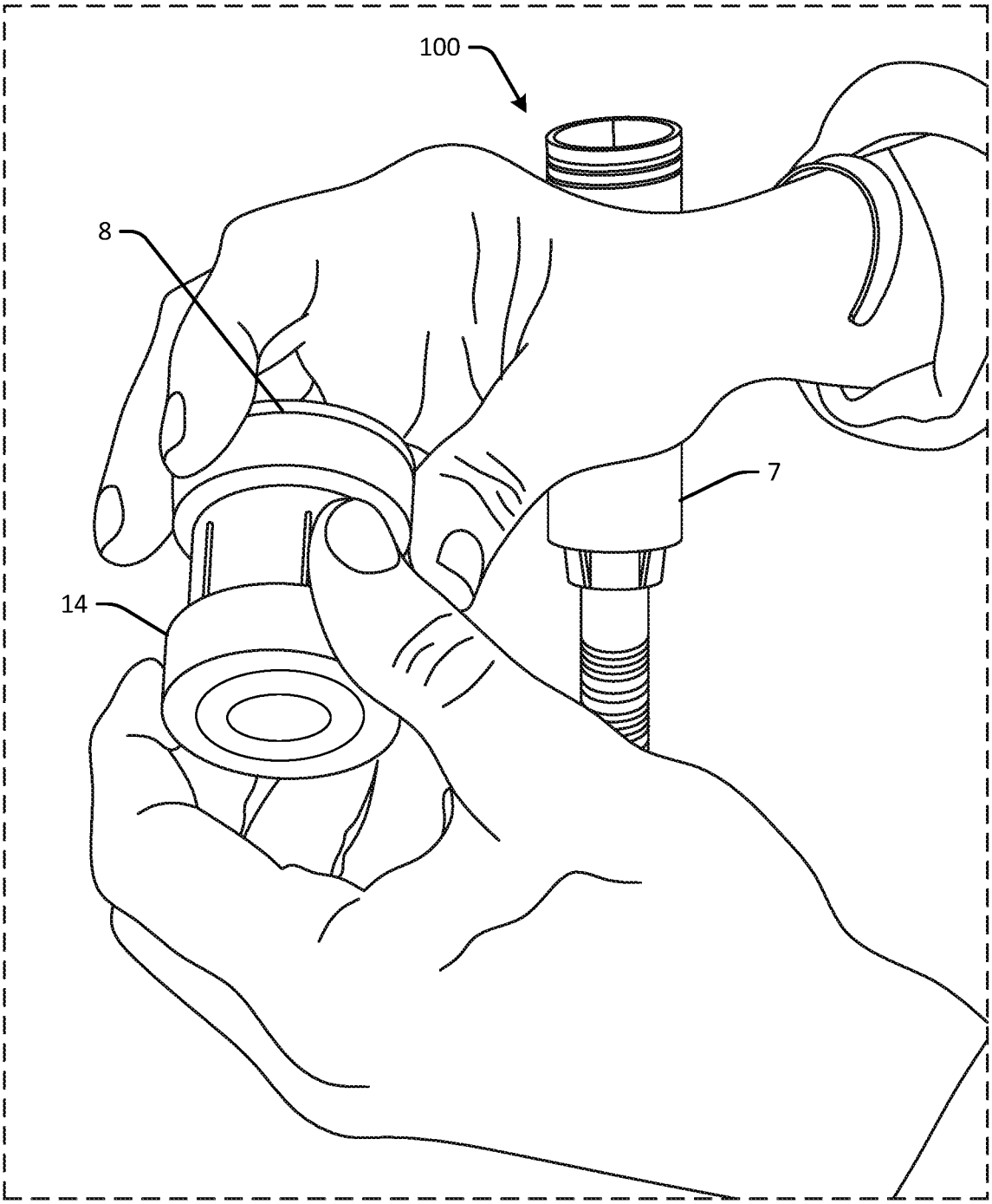
Figure 14:
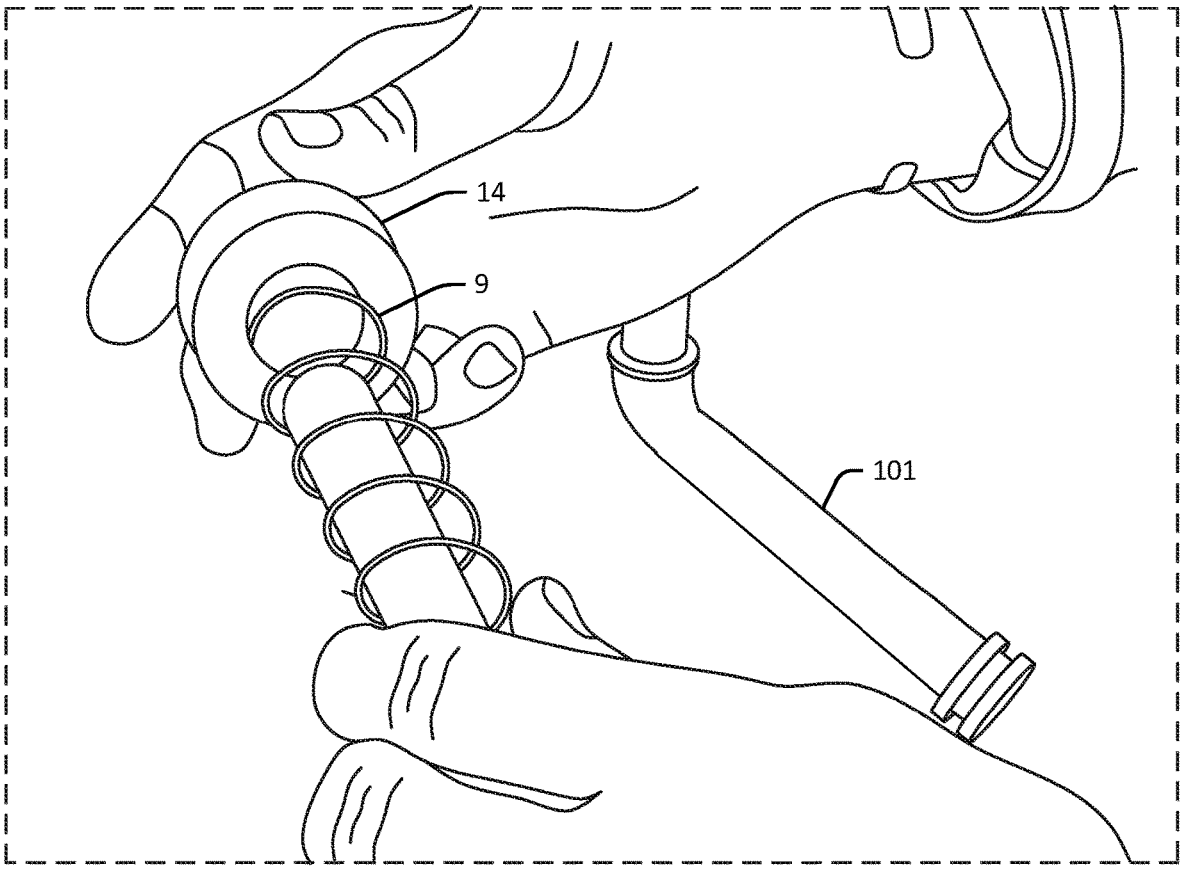
Figure 15:
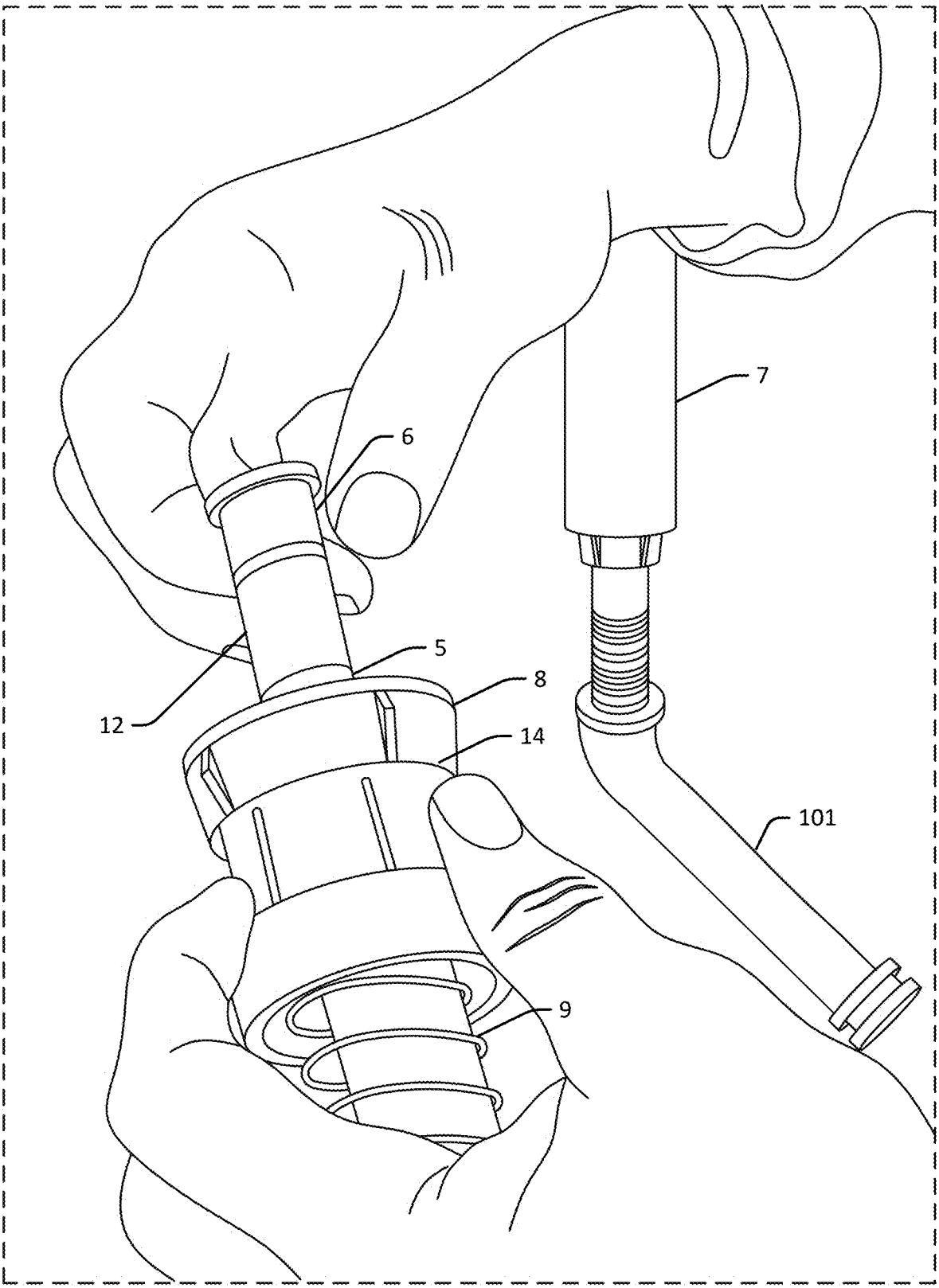
Figure 16:
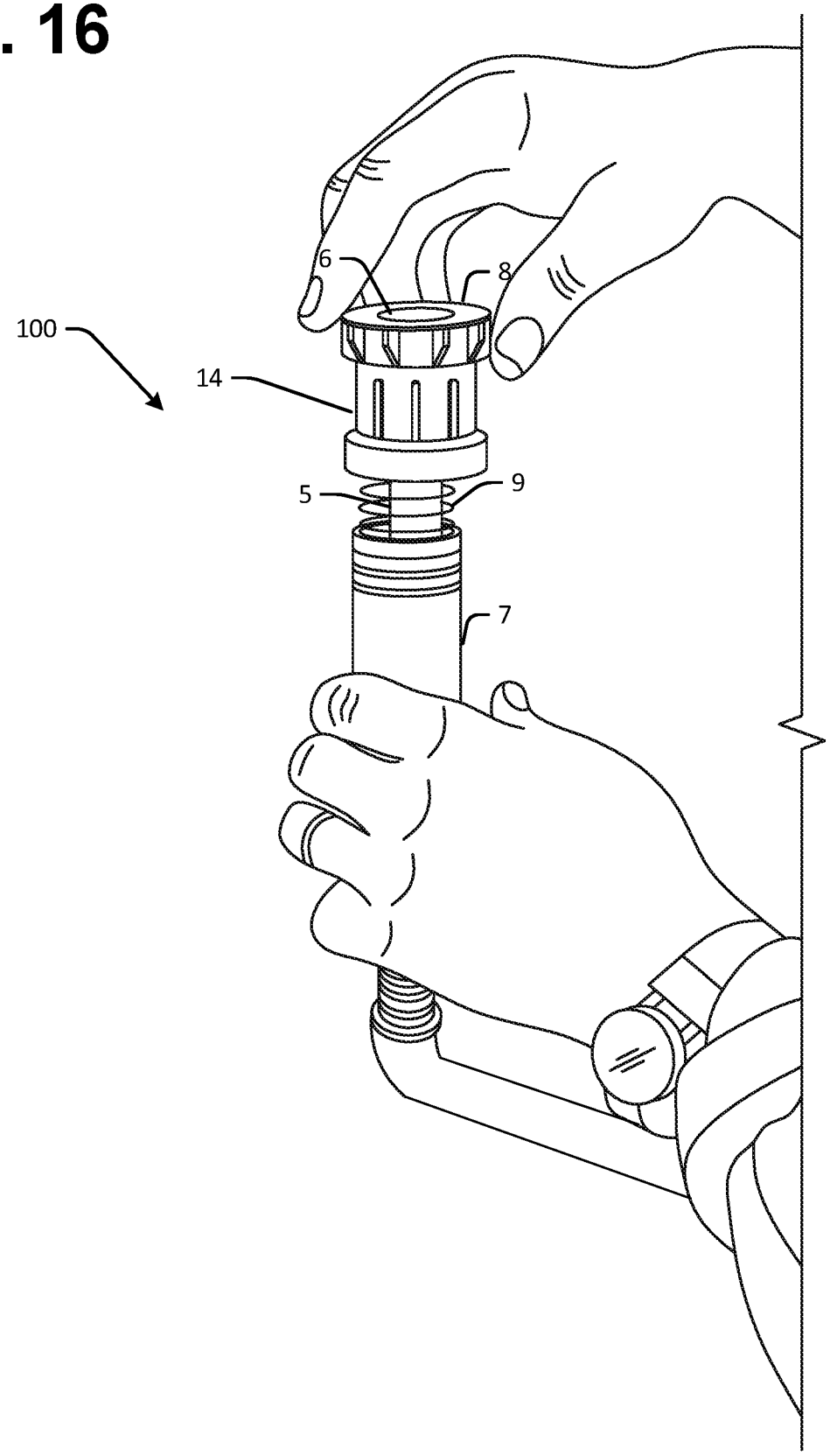
Figure 17:
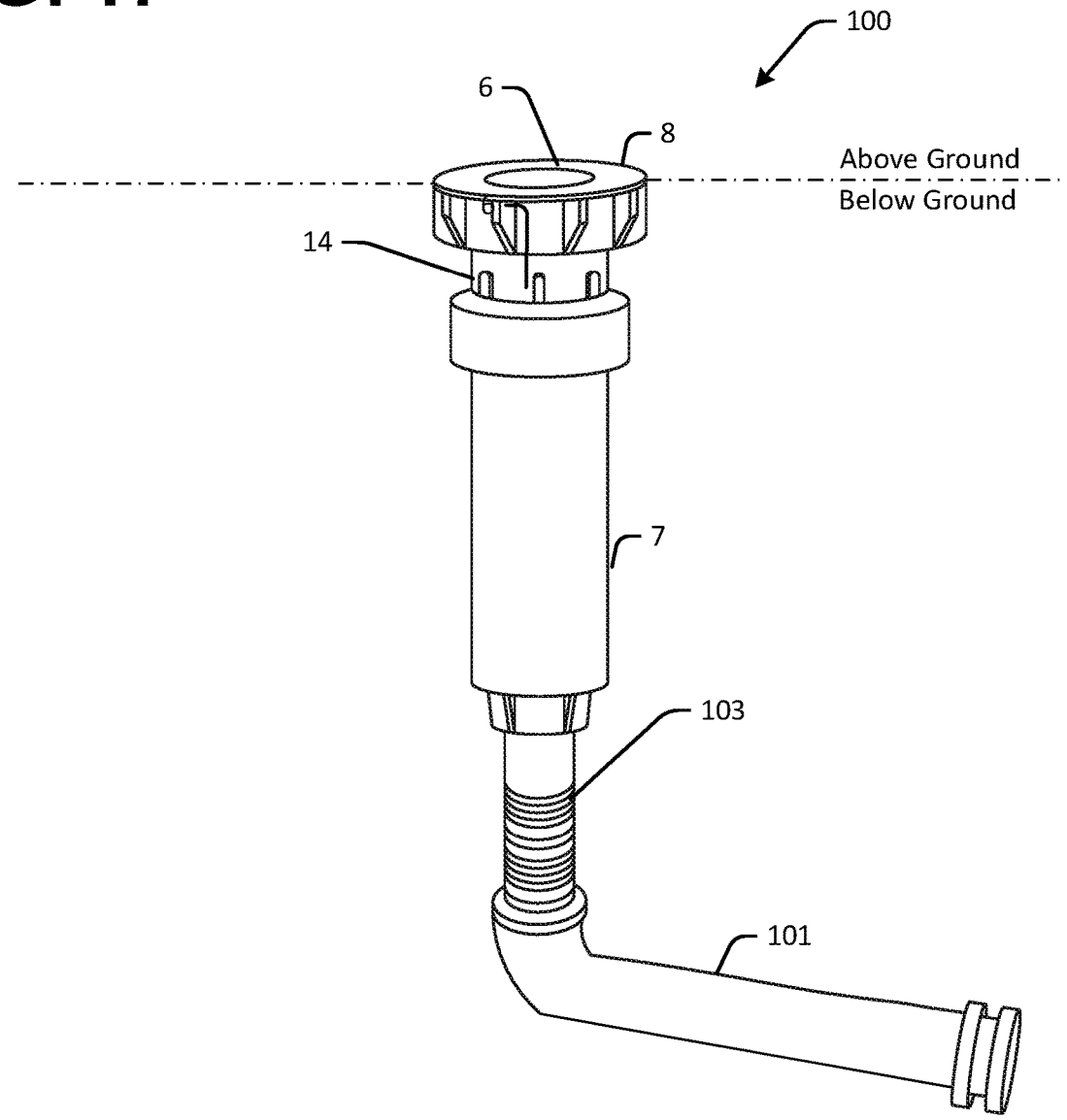

As shown in FIG. 13, the user may thread the extension coupling 14 onto the sprinkler head 8.

As shown in FIGS. 14-17, the user may push the sprinkler riser 5 with extension riser 12 and spring 9 through the opening in the top of the new extension coupling 14. The user may also attach the spray cap 6 to the extension riser 12. The user may then connect the extension coupling 14 to the sprinkler housing 7.

In an example, the user may perform the operations while the housing 7 is still in the ground. The user may also adjust the spray cap 6 for direction of the spray. The pop-up sprinkler with extension riser 12 and extension coupler 14 assembled will now be at the proper height when water pressure is applied to provide better water coverage for the sprinkler.

It is noted that the examples shown and described are provided for purposes of illustration and are not intended to be limiting. Still other examples are also contemplated.

The invention claimed is:

1. A sprinkler extension device, comprising:

an extension riser to mate on a first end to a sprinkler riser, and the extension riser further to mate on a second end to a spray cap; and an extension coupling to mate on a first end to a sprinkler housing, the extension coupling to mate on a second end to a sprinkler head; and an annular recess formed substantially around a circumference within the extension coupling, the annular recess retaining a first end of a spring therein.

2. The sprinkler extension device of claim 1, further comprising at least one ridge on an outside wall of the extension coupling.

3. The sprinkler extension device of claim 2, wherein the at least one ridge is formed integral with the outside wall of the extension coupling.

4. The sprinkler extension device of claim 1, further comprising a plurality of ridges spaced around an outer perimeter of the extension coupling.

5. The sprinkler extension device of claim 1, wherein the extension riser has an outer diameter equal to an outer diameter of the sprinkler riser.

6. The sprinkler extension device of claim 1, wherein the extension coupling has an upper section and a lower section, the lower section having an outer diameter substantially equal to an inner diameter of the sprinkler housing.

7. The sprinkler extension device of claim 6, wherein the upper section of the extension coupling has an outer diameter that is smaller than the outer diameter of the lower section of the extension coupling.

8. The sprinkler extension device of claim 1, wherein the extension riser is coupled with the sprinkler riser of an existing pop-up sprinkler installed in the ground.

9. The sprinkler extension device of claim 1, wherein the extension riser is coupled with the spray cap of an existing pop-up sprinkler installed in the ground.

10. The sprinkler extension device of claim 1, wherein the extension coupling is coupled with the sprinkler housing of an existing pop-up sprinkler installed in the ground.

11. The sprinkler extension device of claim 1, wherein the extension coupling is coupled with the sprinkler head of an existing pop-up sprinkler installed in the ground.

12. The sprinkler extension device of claim 1, wherein the extension riser is provided in various lengths to accommodate different adjustment heights for an existing pop-up sprinkler installed in the ground.

13. The sprinkler extension device of claim 1, wherein the extension coupling is provided in various lengths to accommodate different adjustment heights for an existing pop-up sprinkler installed in the ground.

14. The sprinkler extension device of claim 1, wherein the extension riser is provided in a length corresponding to a length of the extension coupling to accommodate different adjustment heights for an existing pop-up sprinkler installed in the ground.

15. The sprinkler extension device of claim 1, wherein the extension riser accommodates different specifications of sprinkler risers, spray caps, sprinkler housings, and sprinkler heads of existing pop-up sprinklers.

16. A sprinkler extension device, comprising:

an extension riser to mate on a first end to a sprinkler riser, and the extension riser to mate on a second end to a spray cap of an existing pop-up sprinkler installed in the ground;

an extension coupling to mate on a first end to a sprinkler housing, and the extension coupling to mate on a second end to a sprinkler head of the existing pop-up sprinkler installed in the ground; and an annular recess formed substantially around an inner circumference of the extension coupling, the annular recess retaining a first end of a spring therein.

17. A sprinkler extension device, comprising:

an extension riser;

a first threading on a first end of the extension riser to mate the first end of the extension riser to a sprinkler riser;

a second threading on a second end of the extension riser to mate the second end of the extension riser to a spray cap;

an extension coupling;

a third threading on a first end of the extension coupling to mate the first end of the extension coupling to a sprinkler housing;

a fourth threading on a second end of the extension coupling to mate the second end of the extension coupling to a sprinkler head; and an annular recess formed at least partially around an inner circumference of the extension coupling, the annular recess retaining a first end of a spring therein.

18. The sprinkler extension device of claim 17, wherein the extension riser and the extension coupling accommodate different specifications of sprinkler risers, spray caps, sprinkler housings, and sprinkler heads of existing pop-up sprinklers.

* * * * *